US005673014A

United States Patent [19]

Domanits

[11] Patent Number: 5,673,014

[45] Date of Patent: Sep. 30, 1997

[54] GENERAL-PURPOSE CONVERTER FUSE

[75] Inventor: Peter Domanits, Amberg, Germany

[73] Assignee: Siemens Aktiengesellschaft, Munich, Germany

[21] Appl. No.: 460,580

[22] Filed: Jun. 2, 1995

[30] Foreign Application Priority Data

Aug. 1, 1994 [EP] European Pat. Off. ..... 94111993

[51] Int. Cl.[6] ..... H01H 85/04

[52] U.S. Cl. ..... 337/160; 337/158; 337/295

[58] Field of Search ..... 337/160, 161, 337/162, 164, 295, 296, 158, 159

[56] References Cited

U.S. PATENT DOCUMENTS

| | | | |
|---|---|---|---|
| 3,835,431 | 9/1974 | Rosen et al. | 337/161 |
| 4,118,684 | 10/1978 | Mollenhoff | 337/296 |
| 4,357,588 | 11/1982 | Leach et al. | 337/160 |

FOREIGN PATENT DOCUMENTS

| | | |
|---|---|---|
| 19 44 364 | 5/1966 | Germany . |
| 23 48 771 | 4/1975 | Germany . |
| 24 28 569 | 4/1976 | Germany . |
| 2 184 301 | 6/1987 | United Kingdom . |

OTHER PUBLICATIONS

Siemens Catalog, Order No. A19100–J21–A337–V1, Sicher ist Sicher: NH–Sicheruungen von Siemens (Sure is Sure: NH–Fuses of Siemens).

*Primary Examiner*—Leo P. Picard
*Assistant Examiner*—Jayprakash N. Gandhi
*Attorney, Agent, or Firm*—Kenyon & Kenyon

[57] ABSTRACT

In known methods heretofore, one could generally distinguish with respect to design and tripping characteristic between the LVHBC fuse (low-voltage high-breaking-capacity fuse), which protects against overload currents, and the semiconductor protection fuse which is quick-acting in the event of a short-circuit to protect, for example, thyristors. The general-purpose converter fuse according to the present invention combines the advantages of both fuses in one unit. This is achieved by the application of fusible elements, which besides having rows of narrow sites as is customary under known methods heretofore, in addition have a row of narrow sites with comparatively long narrow sites, in whose vicinity a solder deposit is arranged. The general-purpose converter fuse simultaneously assumes the function of an LVHBC fuse and of a semiconductor protection fuse.

20 Claims, 5 Drawing Sheets

GENERAL-PURPOSE CONVERTER FUSE

BACKGROUND OF THE INVENTION

The present invention relates generally to fuses, and more particularly to a general-purpose converter fuse, comprising at least one fusible element with a thickness d, which has at least one row of narrow sites with $n_{NE}$ narrow sites having a continually changing cross-section of the length $l_{NE}$ and of the width $b_{NE}$.

From printed publications, one knows of LVHBC fuses, i.e., low-voltage high-breaking-capacity fuses (see the Siemens brochure, order no.: A19.100-J21-A337-V1). These LVHBC fuses usually employ one or more fusible elements in the form of copper strips. Narrow sites are punched out of each fusible element for selective breaking operations. A solder deposit in the form of rivet-shaped points or loops filled with solder (see FIG. 7) are applied to the fusible element to influence the overload characteristic. If an overload current causes the fusible element to heat up to above the melting temperature of the solder, this solder diffuses into the fusible element material and alloys with it. This causes the electrical resistance to increase, which leads to further heating, so that the diffusion process is accelerated even more until the fusible element is completely loosened in the vicinity of the solder deposit, so that it breaks off, and the current is interrupted. In the case of a brief, permissible overload current, no premature breaking operation is carried out by the LVHBC fuse. On the other hand, all narrow sites of the fusible element open wide, given a large enough short-circuit current. Several small series-connected electric arcs are formed simultaneously, whose voltages add up and lead to a rapid circuit breaking operation.

These LVHBC fuses have a relatively flat time/current characteristic curve and are, thus, suited for use in motor branch circuits, since they do not blow in the event of an overload current of short duration during start-up of a motor. The LVHBC fuses are used to protect equipment or control cabinets from fire caused by overheated connecting cables (e.g., PVC-insulated cables). Their time/current characteristic, i.e., their operating tripping characteristic in the overload range, is prescribed by standards. The $I^2t$-values resulting from the fusing integral and the arc-extinguishing integral are relatively large in the case of LVHBC fuses, i.e., as a rule, LVHBC fuses are not current-limiting in the event of a short-circuit and are, therefore, designated as slow-blowing fuses. As a rule, these LVHBC fuses cannot provide semiconductor protection.

Likewise known are semiconductor protection fuses which are preferably inserted in the rectifier part and in the intermediate circuit of converters. Under operational conditions, they have a high power dissipation, which is why silver is used as a fusible element material. Depending on the rated voltage, the fusible elements of semiconductor protection fuses have a different number of the same kind of rows of narrow sites arranged at equal distances, as is apparent from FIGS. 4 and 5. Depending on the design, different shapes having a continually changing cross-section, such as circles, ovals, rhombi, etc. can be used (see FIG. 6). The rating of a conventional semiconductor protection fuse does not allow any overload protection for rated currents above about 63 A. Its time/current characteristic curve is very steep, i.e., its rated, or nominal current is relatively large given a small breaking integral, i.e., $I^2t$-value, which results in a quick-acting (quick-blow) fuse in the event of a short-circuit. When there are fault currents up to three times the rated or nominal current, so much heat is produced in the fuse already before it blows that the insulating heat sink can burst and the fuse will not be able to interrupt the overload current due to the resulting loss of sand. As a rule, a limiting curve of the permissible load duration is indicated (aR-characteristic) in this range. Because of these properties, a line protection cannot be achieved with conventional semiconductor protection fuses.

FIG. 8 depicts the general profile of the time/current characteristic curves of an LVHBC fuse (dot-dash line) and of a semiconductor protection fuse (solid line in the short-circuit range and interrupted line in the overload range). This elucidates that the time/current characteristic curve of a semiconductor protection fuse is much steeper than that of an LVHBC fuse. It follows from this that in an application for providing simultaneous protection in the overload range and short-circuit protection, an LVHBC fuse and a semiconductor protection fuse are required, whose spark-over performances must be precisely adjusted to one another.

The present invention is therefore directed to the problem of developing a general-purpose converter fuse, which is quick-acting and, in the event of a short-circuit, breaks and, moreover, which is suited as overload protection for connecting cables, i.e., which combines the advantages of a semiconductor protection fuse and an LVHBC fuse.

SUMMARY OF THE INVENTION

The present solves this problem by providing a fuse comprising at least one fusible element of thickness d, which besides having at least one first row of narrow sites (NER) with $n_{NE}$ first narrow sites (NE) with a continually changing cross-section in length $l_{NE}$ and width $b_{NE}$, also has a second row of narrow sites (LER) with $n_{LE}$ second narrow sites (LE) of length $l_{LE}$ and width $b_{LE}$, in which the length $l_{LE}$ is greater than the length $l_{NE}$, the cross-sectional area $n_{LE}\times b_{LE}\times d$ of the second row of narrow sites LER is larger than the cross-sectional area $n_{NE}\times b_{NE}\times d$ of the first row of narrow sites (NER), and a solder deposit is adjacent to the second row of narrow sites (LER).

A fuse of this type is equipped with at least one fusible element of the thickness d, which, besides having at least one first row of narrow sites with $n_{NE}$ first narrow sites having a continually changing cross-section in the length $l_{NE}$ and in the width $b_{NE}$, also has a second row of narrow sites with $n_{LE}$ second narrow sites of the length $l_{LE}$ and of the width $b_{LE}$, the length $l_{LE}$ being greater than the length $l_{NE}$, the cross-sectional area $n_{LE}\times b_{LE}\times d$ of the second row of narrow sites being larger than the cross-sectional area $n_{NE}\times b_{NE}\times d$ of the first row of narrow sites, and a solder deposit being adjacent to the second row of narrow sites. Such a general-purpose fuse unites in one unit the advantages of a semiconductor protection fuse, i.e., extra fast response to and interruption of the electric circuit in the event of a short circuit, e.g., protecting a thyristor from being destroyed, and of an LVHBC fuse, i.e. protecting connecting cables, e.g., PVC-insulated cables from overloading and, thus, from fire. The design meets the specifications of LVHBC fuses specified by DIN 43620 and, thus, renders possible installation in commercial LVHBC fuse mounts or in fuse switch-disconnectors. The advantages attained for the converter customer are reduced space requirements for the fuse, less outlay for cable installation, etc., and, thus, reduced costs in comparison to the simultaneous application of both LVHBC fuses for line protection as well as additional semiconductor protection fuses for protecting the converter.

In addition to general-purpose converter protection, the fuses fulfill the requirements of line protection, e.g. conforming to the large testing current in accordance with VDE 100 T.430 or VDE 0636 T.21 or T.107=IEC 269-2.

The general-purpose fuse in accordance with the invention has a time/current characteristic with a defined short-circuiting performance that corresponds to that of semiconductor protection fuses, in the overload range, i.e., for currents up to five times the rated current and melting (or pre-arcing) times above one second, the spark-over performance being trimmed to produce a faster spark-over, i.e., in this range, the time/current characteristic curve being flatter than in the case of otherwise customary semiconductor protection fuses.

The rated current of the general-purpose converter fuse is smaller than that of the corresponding semiconductor protection fuse having the same $I^2t$-value. On the other hand, the $I^2t$-value of the general-purpose converter fuse is considerably smaller than the $I^2t$-value of an LVHBC fuse for the same rated current.

The present invention also solves the above-mentioned problem by providing a fuse having at least one fusible element comprising a plurality of first rows of narrow sites (NER), which are axially adjacent to one another at the same distance $d_{NER}$ and have a continually changing cross-section, at least one additional third row of narrow sites (ZER) being provided, which is at a shorter distance $d_{ZER}$ to an adjacent first row of narrow sites (NER), and a solder deposit being arranged in the clearance space between the two. This fuse, likewise designated as a general-purpose converter fuse, is provided with at least one fusible element having a plurality of first rows of narrow sites NER, which are axially adjacent to one another at the same distance $d_{NER}$ and have a continually changing cross-section, at least one additional third row of narrow sites ZER being provided, which is at a shorter distance $d_{ZER}$ to an adjacent first row of narrow sites, and a solder deposit being arranged in the clearance space between the two.

BRIEF DESCRIPTION OF THE INVENTION

DETAILED DESCRIPTION

Figure 4:
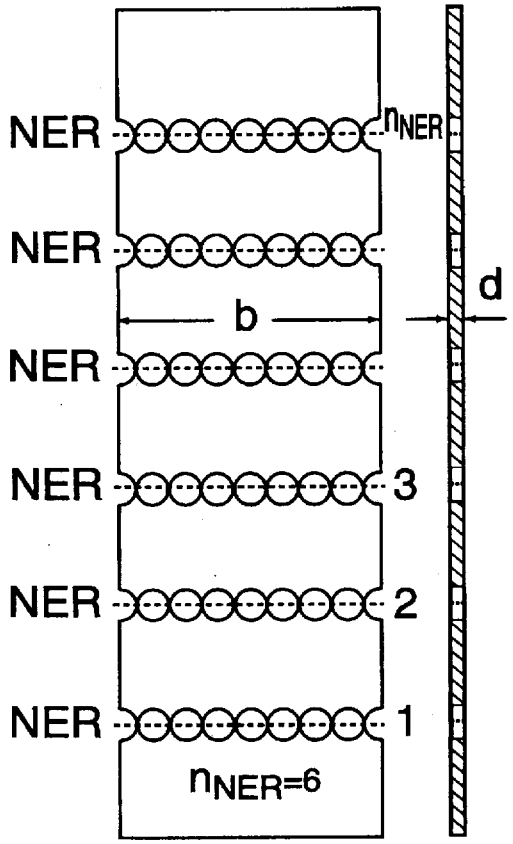
FIG. 4 (PRIOR ART)
FIG. 4 shows the fusible element of a known semiconductor protection fuse with six rows of narrow sites here.
Figure 5:
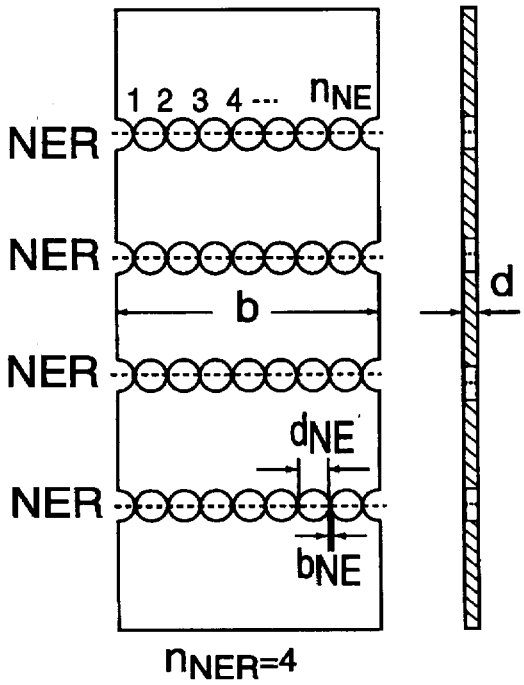
FIG. 5 (PRIOR ART)
FIG. 5 illustrates a fusible element with four rows of narrow sites of a semiconductor protection fuse.
Figure 6:
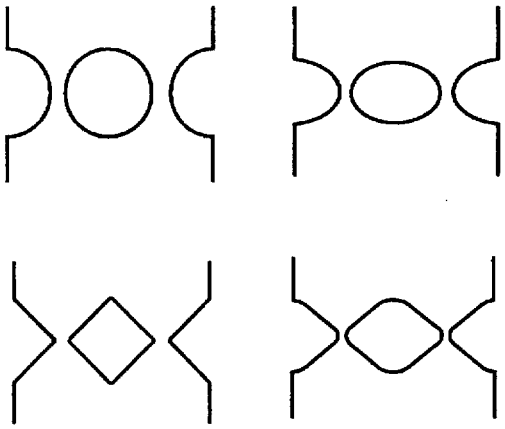
FIG. 6 depicts various hole patterns of narrow sites having a continually changing cross-section in a fusible element of semiconductor protection fuses.

Depending on the rated current, the general-purpose converter fuse consists of one or more parallel fusible elements 1 with mostly similar geometric dimensions. Depending on the rated voltage of the general-purpose converter fuse, viewed in the axial direction, each fusible element 1 (see FIG. 1) has a different number of series-connected rows of narrow sites NER with a reduced cross-section, which are used for short-circuit protection with current limiting. The cross-sectional tapered areas can have the shape of a circle, an ellipse, a thombus, or similar geometric shapes having a continually changing cross-section, as depicted in FIGS. 4,5 or 6 for existing semiconductor protection fuses. The fusible element 1 has a width b and a thickness d and in one row of narrow sites NER has $n_{NE}$ narrow sites NE, each narrow site NE having a width $b_{NE}$. As in the case of semiconductor protection fuses, in the case of the general-purpose converter fuses according to the present invention as well, the ratio of the remaining cross-section $n_{NE} \times b_{NE} \times d$ to the unweakened cross-section $b \times d$ of the fusible element 1 is in the range of about 5% to 12%. The fusible element material of the general-purpose converter fuse can be copper or silver or a combination of both metals.

Figure 7:
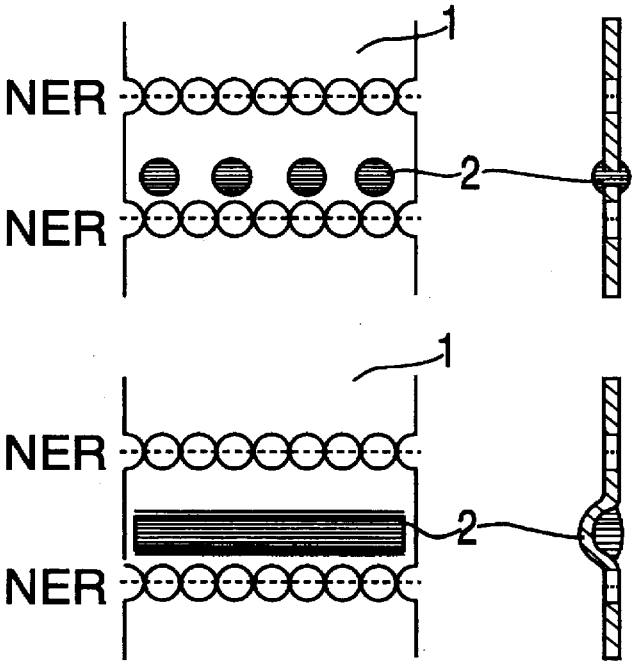
FIG. 7 shows a solder deposit in a fusible element in the form of a rivet and a filled depression.

The general-purpose converter fuse is provided adjacent to a row of narrow sites with a solder deposit 2. The solder deposit 2 consists of a material having a melting temperature which is considerably lower than the melting temperature of the fusible element material. When the fuse unit is overloaded, the low-melting material melts before the fusible element material, diffuses into the structure of the fusible element material, alloys with it, increases the resistance of the fusible element, whereupon the temperature rises again, so that the fusible element 1 melts prematurely and interrupts the current. This low-melting material can be, e.g., a multi-compound solder, pure tin or a similar low-melting metal. The solder deposit can be formed in a generally known way in the shape of a rivet (FIG. 2,3) or a filled depression of the fusible element (see FIG. 7).

Figure 1:
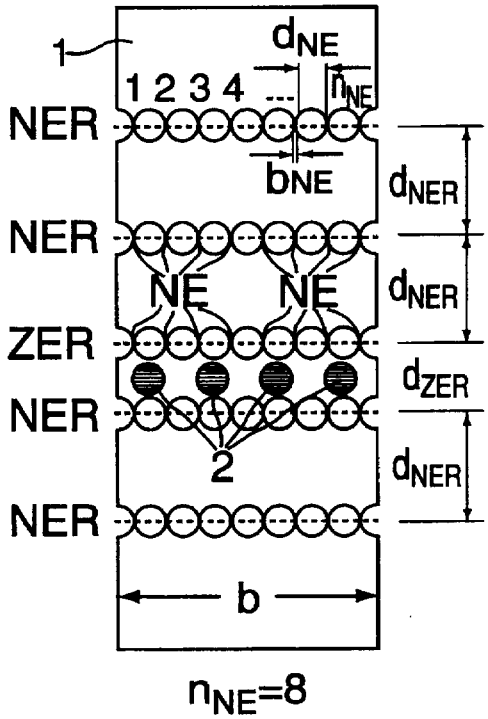
FIG. 1 illustrates a fusible element of a general-purpose converter fuse having an additional row of narrow sites which is adjacent to a solder deposit.

FIG. 1 depicts the fusible element 1 of a general-purpose converter fuse having a plurality of identically designed rows of narrow sites NER, each being at the same distance $d_{NER}$ to the adjacent row of narrow sites NER, with the exception of an additional row of narrow sites ZER, which is at a shorter distance $d_{ZER}$ to an adjacent row of narrow sites NER, a solder deposit 2 being arranged between these two rows of narrow sites NER and ZER. This solder deposit is in the form of a rivet here.

Figure 2:
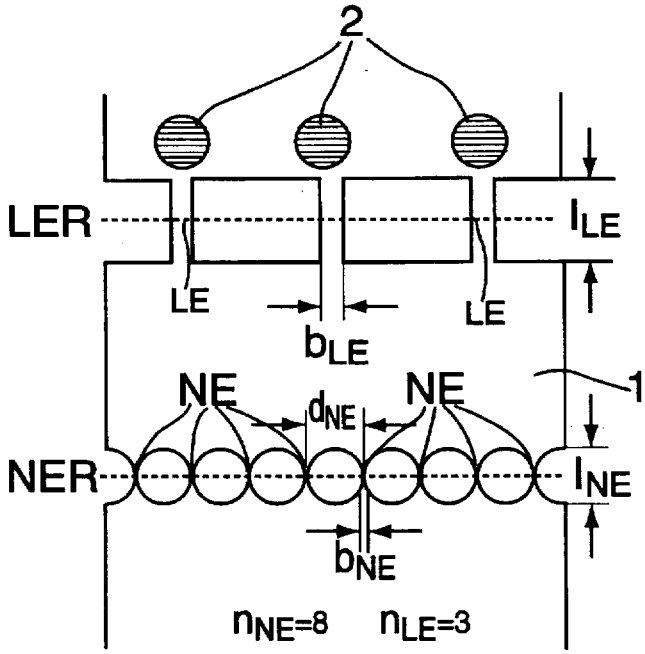
FIG. 2 depicts a detail of a fusible element of a general-purpose converter fuse having a row of narrow sites with long narrow sites of a rectangular hole pattern.
Figure 3:
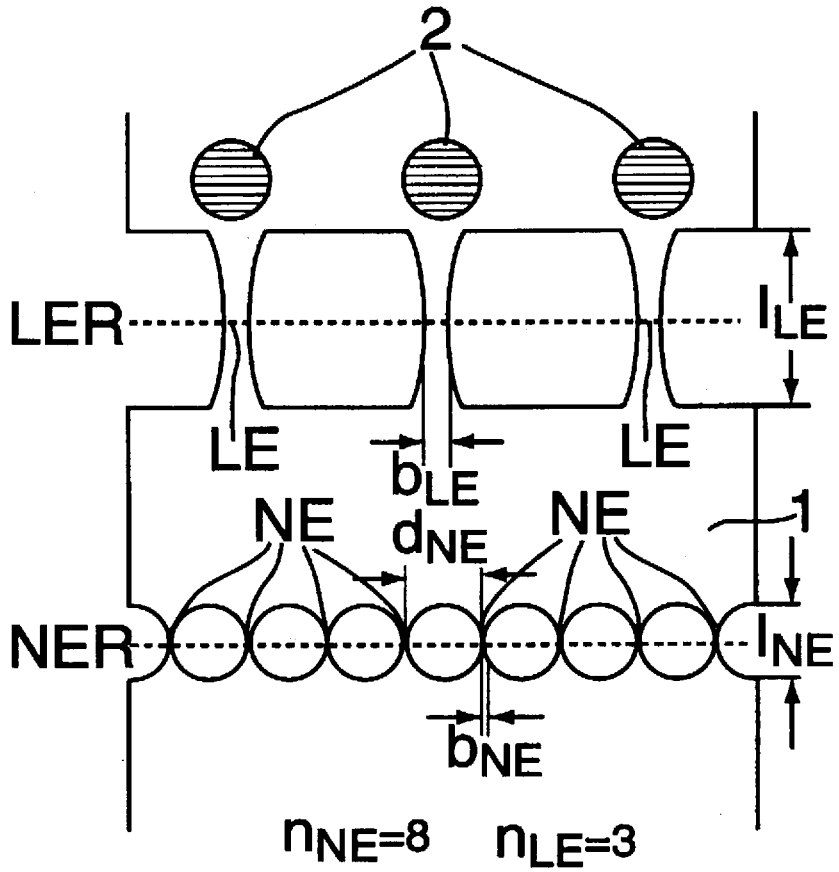
FIG. 3 shows a detail of a fusible element of a general-purpose converter fuse with long narrow sites that change continually in cross-section.

The general-purpose converter fuse can also be equipped with a fusible element 1 having a plurality of rows of narrow sites NER and an additional row of narrow sites LER with comparatively elongated narrow sites LE (see FIGS. 2 and 3). An important characteristic of the long narrow site LE is that the smallest cross-section of the long narrow site LE is larger than the smallest cross-section of a narrow site NE for short-circuit breaking operations, and that the length of the weakened area $l_{LE}$ is considerably greater than the length $l_{NE}$ of a narrow site NE. The factor can lie here more or less in the range of between 1.3 and 3. The shape of the narrow site causes the cooling, i.e., the heat dissipation in the overload range to drop to about five times the rated current, so that the fusible element temperature rises more rapidly and, as a result, the solder deposit melts faster.

FIG. 2 depicts a fusible element 1, in the case of which the long narrow sites LE of the additional row of narrow sites LER are rectangular.

The narrow sites LE in accordance with FIG. 3 have a continually changing cross-section, for example a semi-contour, the smallest cross-sectional surface $n_{LE} \times b_{LE} \times d$ of the additional row of narrow sites LER being greater than the smallest cross-sectional surface $n_{NE} \times b_{NE} \times d$ of the row of narrow sites NER.

The advantages of the design variants in accordance with FIGS. 2 and 3 are the sparking operation of the long narrow sites LE only in the event of an overload, since the heat dissipation in the case of the long narrow sites LE is delayed compared to the normal narrow sites NE.

Figure 8:
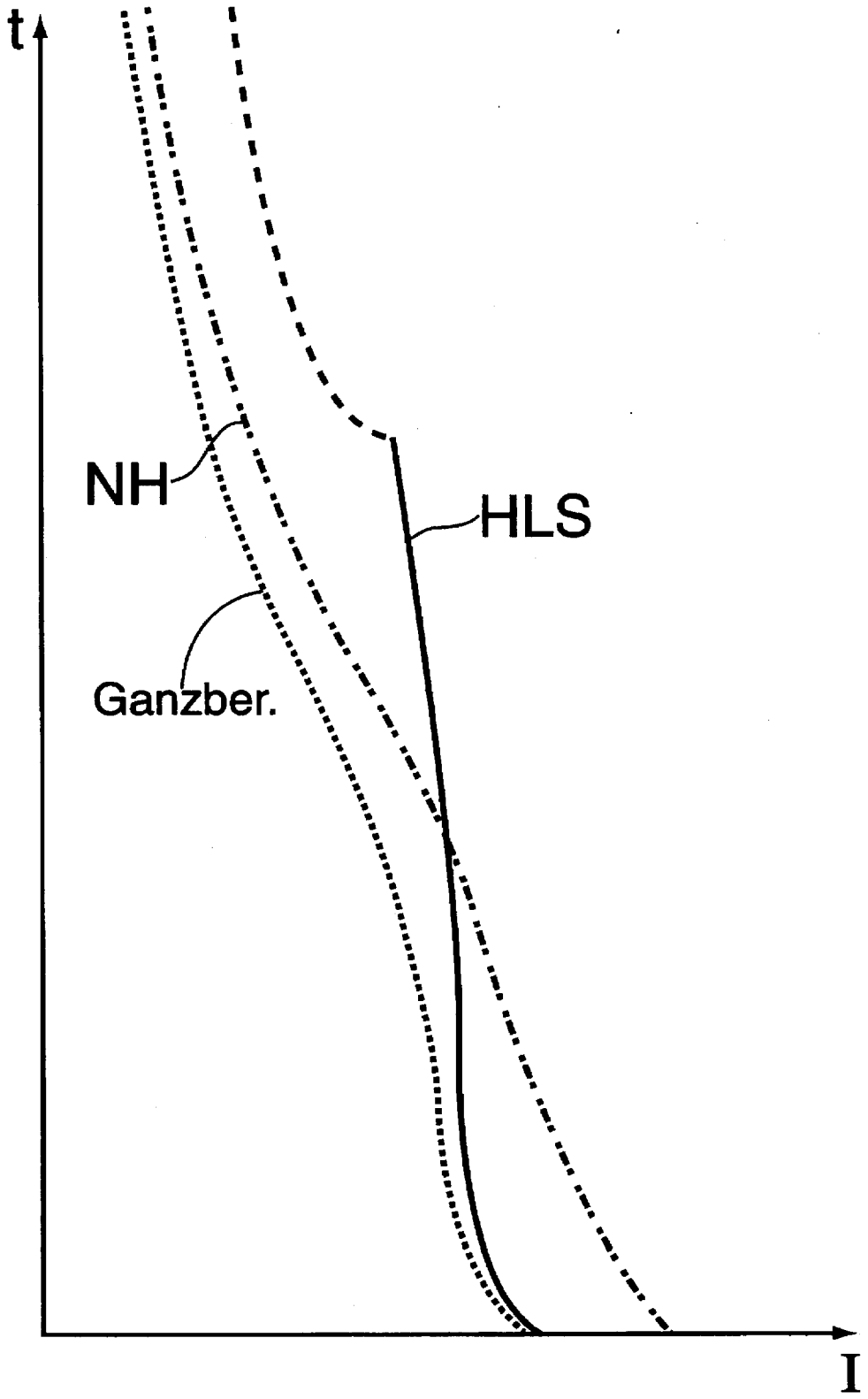
FIG. 8 depicts, in a diagram, the fundamental profile of the time/current characteristic curves of an LVHBC fuse, of a semiconductor protection fuse, and of a general-purpose converter fuse.

In addition to the time/current characteristics for semiconductor protection fuses and for LVHBC fuses, which are already known, FIG. 8 illustrates the time/current characteristic of the general-purpose fuse according to the present invention (dotted line). The latter combines the spark-over performance of the semiconductor protection fuse and of the LVHBC fuse, i.e., the combined spark-over performance can be guaranteed with only one single fuse. In FIG. 8, the pre-arcing (or melting) time t is plotted as an ordinate and the current I on the abscissa.

By selecting a smaller fuse profile, one obtains a smaller surface area and thus a lower thermal capacity. This can be achieved by reducing the number of parallel fusible elements. This results in more compact, less expensive base parts. In summary, the overload characteristic can be influenced to achieve early spark-over in the overload current range by the following points:

Fusible elements having a plurality of series-connected rows of narrow sites, the cross-sectional tapered areas of the narrow sites being able to have different shapes.

The fusible element material consists of copper or silver.

A solder deposit is positioned so as to be adjacent to a row of narrow sites.

Another row of narrow sites, which is adjacent to a solder deposit, is added to the rows of narrow sites which are equally spaced apart.

An additional row of narrow sites with narrow sites of an elongated shape is placed in the fusible element.

The heat-dissipating surface O of the fusible element is reduced in size.

A smallest possible fuse profile is selected.

The measures mentioned above can be applied singly or in combination to the fusible element for the general-purpose converter fuse.

What is claimed is:

1. A fuse comprising at least one fusible element with a thickness (d), said fusible element including:

a) a first row of narrow sites, said first row having a plurality ($n_{NE}$) of first narrow sites, each first narrow site having a continually changing cross-section in length ($l_{NE}$) and width ($b_{NE}$);

b) a second row of narrow sites, said second row having a plurality ($n_{LE}$) of second narrow sites, each second narrow site having a length ($l_{LE}$) greater than said length of the first narrow site ($l_{NE}$) and having a width ($b_{LE}$), wherein a cross-sectional area ($n_{LE} \times b_{LE} \times d$) of the second row of narrow sites is larger than a cross-sectional area ($n_{NE} \times b_{NE} \times d$) of the first row of narrow sites; and c) a solder deposit being disposed adjacent to the second row of narrow sites.

2. The fuse according to claim 1, wherein each of the second narrow sites of the second row of narrow sites has a rectangular design.

3. The fuse according to claim 1, wherein each of the second narrow sites of the second row of narrow sites has a variable cross-section, a smallest cross-sectional surface ($n_{LE} \times b_{LE} \times d$) of the second row of narrow sites is larger than a smallest cross-sectional surface ($n_{NE} \times b_{NE} \times d$) of the first row of narrow sites.

4. The fuse according to claim 1, wherein said length ($l_{LE}$) of each of the second narrow sites is greater than said length ($l_{NE}$) of each of the first narrow sites by a factor with a range of 1.3 to 3.

5. The fuse according to claim 2, wherein said length ($l_{LE}$) of each of the second narrow sites is greater than said length ($l_{NE}$) of each of the first narrow sites by a factor with a range of 1.3 to 3.

6. The fuse according to claim 3, wherein said length ($l_{LE}$) of each of the second narrow sites is greater than said length ($l_{NE}$) of each of the first narrow sites by a factor with a range of 1.3 to 3.

7. The fuse according to claim 1, wherein the fusible element comprises a material made of copper, silver or a combination of both metals.

8. The fuse according to claim 2, wherein the fusible element comprises a material made of copper, silver or a combination of both metals.

9. The fuse according to claim 3, wherein the fusible element comprises a material made of copper, silver or a combination of both metals.

10. The fuse according to claim 4, wherein the fusible element comprises a material made of copper, silver or a combination of both metals.

11. The fuse according to claim 5, wherein the fusible element comprises a material made of copper, silver or a combination of both metals.

12. The fuse according to claim 6, wherein the fusible element comprises a material made of copper, silver or a combination of both metals.

13. The fuse according to claim 1, wherein the fusible element comprises a first material with a first melting temperature, the solder deposit comprises a second material with a second melting temperature, and said second melting temperature is considerably lower than said first melting temperature.

14. The fuse according to claim 7, wherein the solder deposit comprises a material having a melting temperature which is considerably lower than a melting temperature of the material of the fusible element.

15. The fuse according to claim 8, wherein the solder deposit comprises a material having a melting temperature which is considerably lower than a melting temperature of the material of the fusible element.

16. The fuse according to claim 9, wherein the solder deposit comprises a material having a melting temperature which is considerably lower than a melting temperature of the material of the fusible element.

17. The fuse according to claim 10, wherein the solder deposit comprises a material having a melting temperature which is considerably lower than a melting temperature of the material of the fusible element.

18. A fuse including at least one fusible element, said fusible element comprising:

a) a plurality of rows of first narrow sites (NER), which are axially adjacent to one another and equidistant to one another by a first distance ($d_{NER}$), each of the first narrow sites having a continually changing cross-section;

b) at least one row of additional narrow sites, which is disposed at a second distance ($d_{ZER}$) to one row of the plurality of rows of first narrow sites, which said one row is adjacent to the at least one row of additional narrow sites, wherein the second distance is shorter than the first distance; and c) a solder deposit being disposed between said one row of the plurality of rows of first narrow sites and the at least one row of additional narrow sites.

19. The fuse according to claim 18, wherein the fusible element comprises a material made of copper, silver or a combination of both metals.

20. The fuse according to claim 19, wherein the solder deposit comprises a material having a melting temperature which is considerably lower than a melting temperature of the material of the fusible element.

* * * * *